United States Patent [19]

Sims

[11] Patent Number: 5,065,919

[45] Date of Patent: Nov. 19, 1991

[54] SLING SUPPORT APPARATUS

[76] Inventor: George W. Sims, 104 Greenview Dr., Lawrenceburg, Ky. 40342

[21] Appl. No.: 619,392

[22] Filed: Nov. 29, 1990

[51] Int. Cl.[5] ..... A45F 3/14

[52] U.S. Cl. ..... 224/257; 224/264; 224/272; 224/909

[58] Field of Search ..... 824/909, 908, 910, 257, 824/258, 202, 255, 271, 272, 264

[56] References Cited

U.S. PATENT DOCUMENTS

| | | | |
|---|---|---|---|
| 860,794 | 7/1907 | Felts | 224/272 |
| 3,326,430 | 6/1967 | Banks | 224/909 |
| 3,326,431 | 6/1967 | Bellens | 224/909 |
| 3,326,432 | 6/1967 | Banks et al. | 224/909 |
| 3,526,347 | 9/1970 | Kuban | 224/909 |
| 4,556,159 | 12/1985 | Swain | 224/909 |

*Primary Examiner*—Linda J. Sholl
*Attorney, Agent, or Firm*—Leon Gilden

[57] ABSTRACT

A sling support apparatus is provided for mounting about an individual, wherein the apparatus includes an elongate flexible cord mounting a pulley plate member, with the pulley plate member mounting a pulley therewithin to capture the flexible cord between a pulley and a support mount, wherein the support mount rotatably mounts a lower support mount to secure a separable fastener thereto, wherein the separable fastener mounts a support cord, and the support cord including opposed rings to secure binoculars and the like thereto. A spring biased clip, including a spaced jaws of serrated teeth is also provided and mounted to a second cord for securement to the support cord and mounting to an individual's support belt to position the organization to the individual's torso.

6 Claims, 2 Drawing Sheets

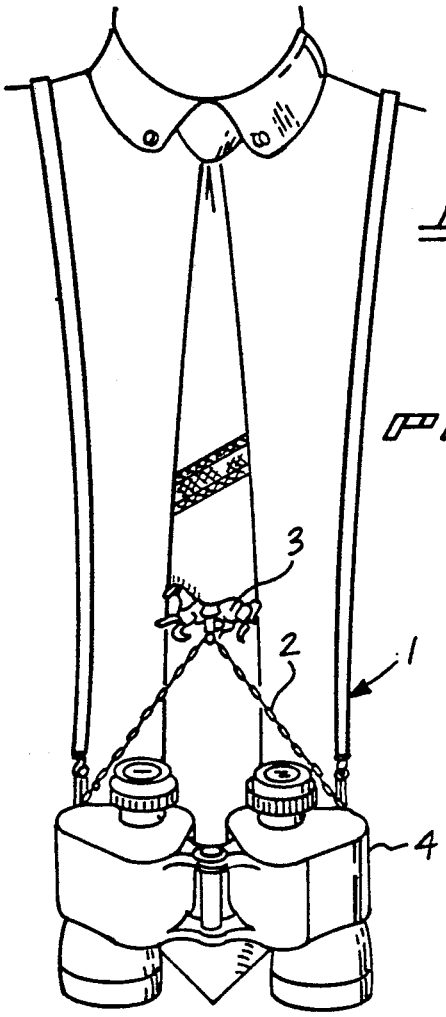
FIG 1
PRIOR ART
FIG 2
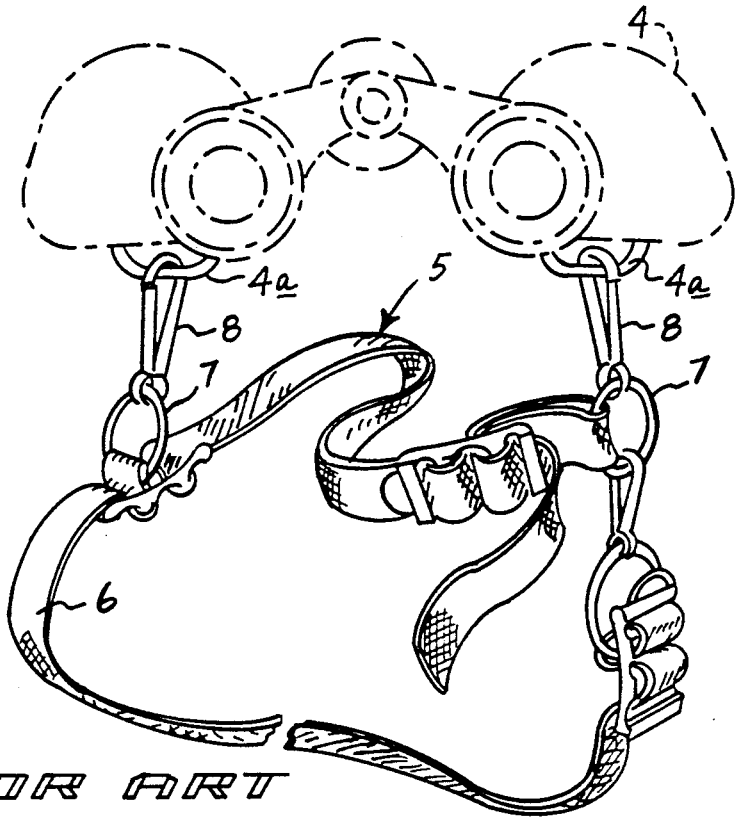
PRIOR ART

SLING SUPPORT APPARATUS

BACKGROUND OF THE INVENTION

1. Field of the Invention

The field of invention relates to support apparatus, and more particularly pertains to a new and improved sling support apparatus to permit convenience and ease of securement of components relative to an individual.

2. Description of the Prior Art

Various sling and cord structure has been provided in the prior art for mounting binoculars, cameras, and the like about individuals during their transport and use. The instant invention attempts to overcome deficiencies of the prior art by permitting securement of such components in a manner to permit their ease of use and their access during use. Examples of the prior art include U.S. Pat. No. 3,326,431 to Belleni wherein a safety chain is provided in addition to a support strap mounting binoculars, wherein a safety chain is mounted to a pin structure positioned medially of a shirt portion of an individual.

U.S. Pat. No. 3,326,432 to Banks sets forth a strap structure including clip members at spaced portions thereof to support a binocular member to the strap portion.

U.S. Pat. No. 3,326,430 to Banks provides a harness structure utilizing a plurality of straps mounted to a binocular pair to provide a safety organization relative to support of the binocular pair.

U.S. Pat. No. 3,526,347 to Kuban sets forth a binocular support strap providing a crossed structure to support and mount binocular pair in a contiguous relationship relative an individual.

U.S. Pat. No. 4,556,159 to Swain provides for a protective holder of binoculars, wherein the holder sets forth an elastomeric band mounted to binoculars in their support.

As such, it may be appreciated that there continues to be a need for a new and improved sling support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of sling support apparatus now present in the prior art, the present invention provides a sling support apparatus wherein the same sets forth a rotatably mounted binocular support structure mounted to a support cord for convenience of positioning and mounting of binoculars and like components relative to an individual. As such, the general purpose of the present invention, which will be described subsequently in greater detail, is to provide a new and improved sling support apparatus which has all the advantages of the prior art sling support apparatus and none of the disadvantages.

To attain this, the present invention provides a sling support apparatus for mounting about an individual, wherein the apparatus includes an elongate flexible cord mounting a pulley plate member, with the pulley plate member mounting a pulley therewithin to capture the flexible cord between a pulley and a support mount, wherein the support mount rotatably mounts a lower support mount to secure a separable fastener thereto, wherein the separable fastener mounts a support cord, and the support cord including opposed rings to secure binoculars and the like thereto. A spring biased clip, including spaced jaws of serrated teeth is also provided and mounted to a second cord for securement to the support cord and mounting to an individual's support belt to position the organization to the individual's torso.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sling support apparatus which has all the advantages of the prior art sling support apparatus and none of the disadvantages.

It is another object of the present invention to provide a new and improved sling support apparatus which may be easily and efficiently manufactured and marketed.

It is a further object of the present invention to provide a new and improved sling support apparatus which is of a durable and reliable construction.

An even further object of the present invention is to provide a new and improved sling support apparatus which is susceptible of a low cost of manufacture with regard to both materials and labor, and which accordingly is then susceptible of low prices of sale to the consuming public, thereby making such sling support apparatus economically available to the buying public.

Still yet another object of the present invention is to provide a new and improved sling support apparatus which provides in the apparatuses and methods of the prior art some of the advantages thereof, while simultaneously overcoming some of the disadvantages normally associated therewith.

Still another object of the present invention is to provide a new and improved sling support apparatus wherein the same permits positioning and mounting of binoculars and the like relative to an individual in a rotatably repositionable manner relative to a sling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view, taken in elevation, of a prior art strap support structure for binoculars.

FIG. 2 is an isometric illustration of a further prior art strap structure for mounting binoculars.

DESCRIPTION OF THE PREFERRED EMBODIMENT

Figure 3:
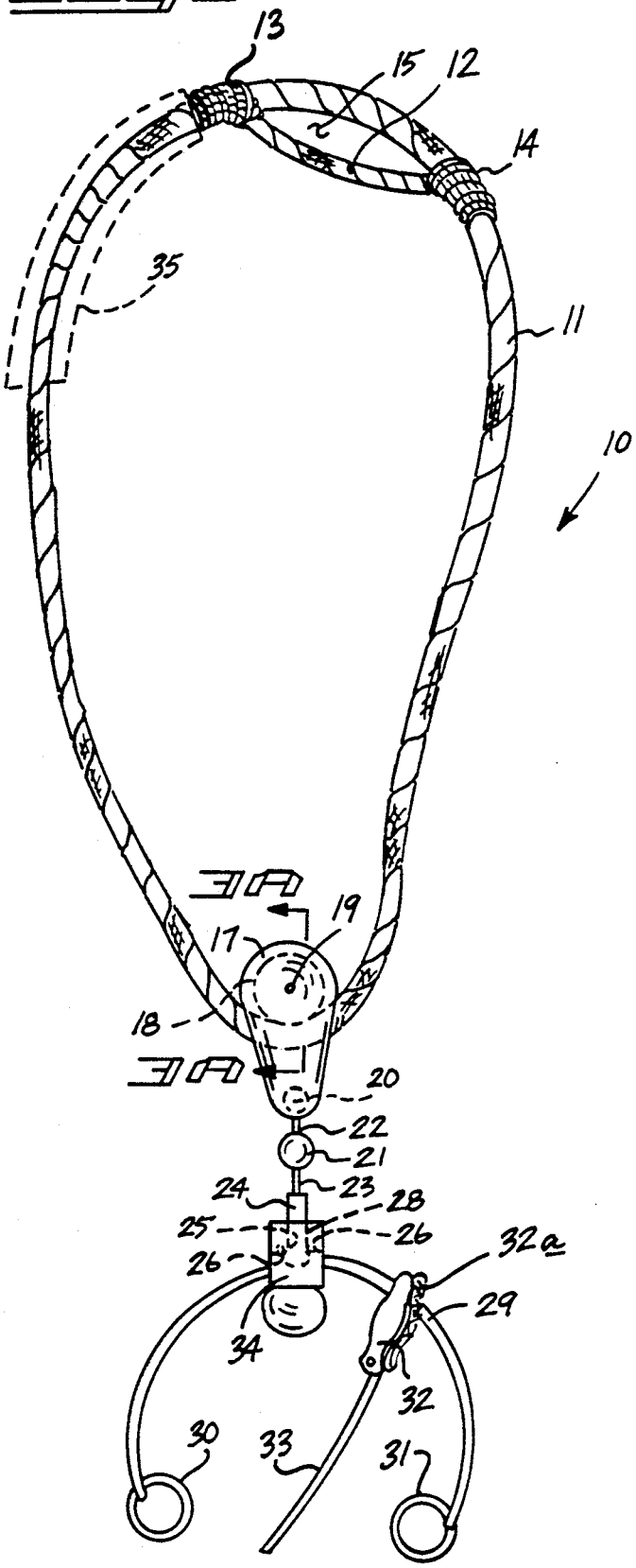
FIG. 3 is an orthographic view, taken in elevation, of the instant invention.
Figure 3A:
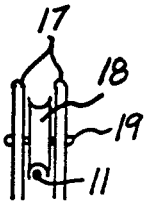
FIG. 3*a* is an orthographic view, taken along the lines 3*a*—3*a* of FIG. 3 in the direction indicated by the arrows.

With reference now to the drawings, and in particular to FIGS. 1 to 4 thereof, a new and improved sling structure apparatus embodying the principles and concepts of the present invention and generally designated by the reference numeral 10 will be described.

FIG. 1 illustrates a prior art support structure 1, wherein in additional to a plurality of support straps, a safety chain 2 is mounted to a clip structure 3 to secure the binoculars 4 thereon and position the binoculars relative to an individual during their transport. FIG. 2 illustrates a further prior art support structure 5, wherein a strap 6 includes a plurality of adjustment clips, with a plurality of spaced rings 7 mounting spring clips 8 to secure the spring clips to spaced binocular loops 4*a* mounted to the associated binoculars 4.

Figure 4:
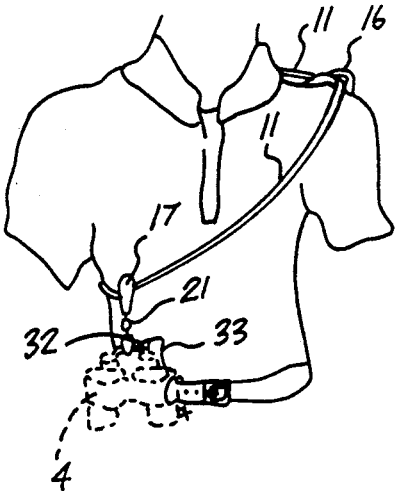
FIG. 4 is an orthographic view, taken in elevation, of the instant invention mounted about an individual.

More specifically, the sling support apparatus 10 of the instant invention essentially comprises an elongate continuous flexible cord 11, with the flexible cord 11 including a traversing secondary cord 12 mounted at spaced positions on the flexible cord 11 and mounted by a respective first and second fastener member 13 and 14 at opposed terminal ends of the secondary cord 12 to define an enclosed elongate opening 15 between the secondary cord 12 and the flexible cord 11. The opening 15 permits a shoulder strap 16 or a button-like apparatus directed through the opening 15 for secure mounting to a shirt, as illustrated in FIG. 4.

Spaced parallel pulley plates 17 include a pulley 18 mounted rotatably therebetween upon a pulley axle 19 that is orthogonally and fixedly secured between the spaced pulley plates 17. The flexible cord 11 is captured between the spaced pulley plates 17 about the pulley 18 by a first support mount 20 mounted between the spaced pulley plates below the pulley 18. The first support mount 20 includes a second support mount 21, with a top rod 22 rotatably mounting the second support mount 21 relative to the first support mount 20. A bottom rod 23 extends from the second support mount 21 aligned with the top rod 22 for securement to an upper terminal end of a fastener shaft 24. The fastener shaft 24 is removably mounted within a fastener boss bore 28 of a fastener boss 34. An annular fastener shaft recess 25 receives a plurality of spring-biased detent spheres 26 normally biased within the annular shaft recess 25 to secure the fastener shaft 24 within the fastener boss, but permits selective removal therefrom as required to use the associated binoculars 4, in a manner as illustrated in FIG. 4. A first support cord 29 is medially secured by the fastener boss 34, and includes a first and second ring member 30 and 31 respectively at opposed terminal ends of the first support cord 29, wherein each ring member is secured to an associated binocular loop 4*a*, of a type as illustrated in FIG. 2 for example. A spring-biased clip 32, including spaced jaws with interiorly serrated teeth 32*a*, is secured to the flexible cord 29 as required, with a second support cord 39 secured to the spring-biased clip 32 at an upper terminal end of the second support cord 33 and mounted to the wearer's belt to secure and position the binoculars in place to an individual's torso during physical activity.

Further, camera modifications may be employed wherein discrete portions of the flexible cord 11 or flexible cord loop 11 is provided with enhanced padding 35 enveloping a discrete portion of the cord loop 11 for ease and comfort of transport of components of enhanced weight, such as binoculars and the like weighing in excess of several pounds.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sling support apparatus including an elongate continuous flexible cord loop, with the cord loop for permitting repositioning of the pulley means relative to the cord loop, and the pulley means including a pulley mounted upon the cord loop, and the pulley means further including a fastener member mounted to the pulley means, the fastener member mounted to a fastener boss selectively removable from the fastener member, and the fastener boss including a first support cord, the first support cord integrally and medially mounted of its length relative to the fastener boss, and the first support cord including a first and second free terminal end, with the first and second free terminal ends including a respective first and second ring member mounted to the respective first and second free terminal end, and the first and second ring members arranged for securement to respective binocular loops, the binocular loops mounted to an associated binocular member.

2. An apparatus as set forth in claim 1 wherein the cord loop includes a traversing secondary cord, with the traversing secondary cord including a first and second secondary cord terminal end, with the first and second traversing cord terminal end mounted at spaced positions upon the cord loop, and including a respective first and second fastener member to secure the respective first and second secondary cord terminal ends to the spaced positions of the cord loop.

3. An apparatus as set forth in claim 2 wherein the pulley means includes spaced parallel pulley plates, with the pulley rotatably mounted between the pulley plates, and a first support mount mounted between the pulley plates spaced from the pulley to capture the cord loop between the first support mount and the pulley.

4. An apparatus as set forth in claim 3 wherein the first support mount includes a top rod, the top rod includes a second support mount mounted to the top rod spaced from the first support mount, wherein the top rod permits rotation of the second support mount relative to the first support mount, and the top rod mounted to the fastener member.

5. An apparatus as set forth in claim 4 wherein the fastener member is received within a bore, with the bore formed within the fastener boss, and the fastener member including an annular recess, the annular recess including a plurality of spring-biased detent spheres to normally be received within the annular recess to secure the fastener member within the fastener boss.

6. An apparatus as set forth in claim 5 further including a spring-biased clip, wherein the spring biased clip includes spaced jaws, including serrated teeth formed within the spaced jaws to secure the spring-biased clip onto the cord loop, and the clip including a second support cord, with the second support cord mounted to the spring-biased clip at an upper terminal end of the second support cord for mounted to an individual's belt at a lower terminal end of the second support cord.

* * * * *